US012351935B2

(12) United States Patent
Gleissner et al.

(10) Patent No.: US 12,351,935 B2
(45) Date of Patent: Jul. 8, 2025

(54) DISTRIBUTION SYSTEM FOR A PROCESS FLUID FOR CHEMICAL AND/OR ELECTROLYTIC SURFACE TREATMENT OF A SUBSTRATE

(71) Applicant: SEMSYSCO GMBH, Salzburg (AT)

(72) Inventors: Andreas Gleissner, Döbriach (AT); Georg Hofer, Stadl-Predlitz (AT); Marianne Kolitsch-MataIn, Villach (AT)

(73) Assignee: SEMSYSCO GMBH, Salzburg (AT)

( * ) Notice: Subject to any disclaimer, the term of this patent is extended or adjusted under 35 U.S.C. 154(b) by 0 days.

(21) Appl. No.: 18/280,784

(22) PCT Filed: Dec. 2, 2021

(86) PCT No.: PCT/EP2021/083922

§ 371 (c)(1),
(2) Date: Sep. 7, 2023

(87) PCT Pub. No.: WO2022/189017

PCT Pub. Date: Sep. 15, 2022

(65) Prior Publication Data

US 2024/0141534 A1 May 2, 2024

(30) Foreign Application Priority Data

Mar. 9, 2021 (EP) ..... 21161506

(51) Int. Cl.
*C25D 5/08* (2006.01)
*C25D 5/04* (2006.01)
(Continued)

(52) U.S. Cl.
CPC ..... *C25D 5/08* (2013.01); *C25D 5/04* (2013.01); *C25D 17/001* (2013.01); *C25D 21/10* (2013.01)

(58) Field of Classification Search
None
See application file for complete search history.

(56) References Cited

U.S. PATENT DOCUMENTS

2004/0060573 A1 4/2004 Woods
2004/0084318 A1 5/2004 Cohen
(Continued)

FOREIGN PATENT DOCUMENTS

EP 1619275 A2 1/2006

OTHER PUBLICATIONS

Extended European Search Report for Application No. 21161506.7, dated Aug. 18, 2021.
(Continued)

*Primary Examiner* — Wojciech Haske
(74) *Attorney, Agent, or Firm* — MARSHALL, GERSTEIN & BORUN LLP

(57) ABSTRACT

The disclosure relates to a distribution system for a process fluid for a chemical and/or electrolytic surface treatment of a substrate, comprising: a distribution body, and a substrate holder, wherein the substrate holder has a substrate holder length (L) and a substrate holder width (W) and is configured to hold the substrate to be treated, wherein the distribution body comprises several openings for a process fluid and/or an electric current, wherein the distribution body and the substrate holder are moveable relative to each other, wherein the distribution body has a distribution body length (l) and a distribution body width (w), and wherein the distribution body length (l) is smaller than the substrate holder length (L).

19 Claims, 9 Drawing Sheets

(51) Int. Cl.
*C25D 17/00* (2006.01)
*C25D 21/10* (2006.01)

(56) References Cited

U.S. PATENT DOCUMENTS

| | | | | |
|---|---|---|---|---|
| 2006/0081478 | A1 | 4/2006 | Sahoda et al. | |
| 2008/0271992 | A1* | 11/2008 | Dordi | C25D 7/123 204/224 R |
| 2013/0001087 | A1 | 1/2013 | Asa et al. | |
| 2018/0282892 | A1* | 10/2018 | Fujikata | C25D 7/12 |
| 2019/0127875 | A1 | 5/2019 | Chang et al. | |

OTHER PUBLICATIONS

First Communication pursuant to Article 94(3) EPC for European Application No. 21161506.7, dated Dec. 5, 2022.
Second Communication pursuant to Article 94(3) EPC for European Application No. 21161506.7, dated May 9, 2023.
International Search Report and Written Opinion of the International Searching Authority for Application No. PCT/EP2021/083922, dated Jan. 26, 2022.

* cited by examiner

DISTRIBUTION SYSTEM FOR A PROCESS FLUID FOR CHEMICAL AND/OR ELECTROLYTIC SURFACE TREATMENT OF A SUBSTRATE

CROSS-REFERENCE TO RELATED APPLICATIONS

This present application is the US national phase of International Patent Application No. PCT/EP2021/083922, filed Dec. 2, 2021, which claims priority to European Application No. 21161506.7, filed Mar. 9, 2021. These applications are hereby incorporated by reference in their entireties.

TECHNICAL FIELD

The disclosure relates to a distribution system for a process fluid for a chemical and/or electrolytic surface treatment of a substrate, a use of a distribution system for a chemical and/or electrolytic treatment of a surface of a substrate, and a distribution method for a chemical and/or electrolytic surface treatment of a substrate.

BACKGROUND

Substrate dimensions of panels for producing large substrates as display panels or printed circuit boards (PCBs) are undergoing significant increases in their dimensions in order to increase manufacturing efficiency as well as to accommodate large size technology requirements.

The best processing results are achieved today with so-called HSP systems, meaning systems containing High Speed Plating technology. In such a system, one or two HSPs together with one or two substrates are immersed into a tank containing an electrolyte and one or several anodes. Within this tank filled with electrolyte, the electrolyte (and with this the current distribution) is directed through the HSP plate(s) towards the substrate surface(s).

Uniform electroplating using HSP systems requires that a high uniform flow field over the complete active area of the panel can be established and controlled. The active area is the space where the process on the substrate is targeted to happen, e.g. copper (or another metal) deposition with very high spatial uniformity. With the panels to be plated getting bigger also the HSP system needs to scale up resulting in an increased complexity and high manufacturing costs.

In the prior art, the size of the HSP-systems is limited by manufacturability limitations to a size of substrates of the so called G6 technology generation. Therefore, the size of treatable substrate surfaces is restricted by the manufacturability limitations of the HSP-systems.

SUMMARY DISCLOSURE

Hence, there may be a need to provide an improved distribution system for a process fluid for chemical and/or electrolytic surface treatment of a substrate, which allows a treatment of large-sized substrates for in particular beyond G6 technology generations (1500 mm×1800-1850 mm).

This problem is solved by the subject-matters of the independent claims, wherein further embodiments are incorporated in the dependent claims. It should be noted that the aspects of the disclosure described in the following also apply to a distribution system for a process fluid for a chemical and/or electrolytic surface, a use of a distribution system for a chemical and/or electrolytic treatment of a surface of a substrate, and a distribution method for a chemical and/or electrolytic surface treatment of a substrate.

According to the present disclosure, a distribution system for a process fluid for chemical and/or electrolytic surface treatment of a substrate is presented. The distribution system comprises a distribution body and a substrate holder. The distribution body and the substrate holder are movable relative to each other. The substrate holder has a substrate holder length and a substrate holder width and is configured to hold the substrate to be treated. The distribution body comprises several openings for a process fluid and/or an electric current and has a distribution body length and a distribution body width, wherein the distribution body length is smaller than the substrate holder length.

The distribution body may define a predefined processing area, which may be configured to cover at least a partial area of the substrate at a certain moment in time, wherein the predefined processing area may be designed not to be equal or approximately equal to the total size of the substrate holder. The relative movement between the substrate holder and the distribution system may allow covering the whole surface of the substrate to be treated by progressively scanning the whole surface of the substrate with the distribution body. At least some of the several openings of the distribution body may be configured to direct the process fluid to the surface of the substrate to be treated while providing a highly uniform current density distribution over the covered predefined processing area.

The movement of the distribution body and the substrate holder may be a linear movement along the length of the substrate holder. This may provide a complete coverage of the substrate holder surface while providing an even treatment throughout the substrate. The movement may exclude a rotational motion, which would cause an excessive treatment at, for instance, the central area of the substrate.

Substrates of G6 (or GEN6) technology generation and bigger may be usually treated by horizontal processing due to their size of at least 1500 mm×1800 mm and larger. Further, the distribution system may provide, in some aspects, additional manufacturing advantages also for earlier technology generations starting at G3.5 (600 mm×720 mm) and beyond.

Electrolytic treatment of the surface of the substrate may include (electro-) plating, reverse (electro-) plating, (electro-etching, etc. Chemical treatment of the surface of the substrate may include acid wash matching, passivation etc.

In an embodiment, the distribution system may comprise at least two distribution bodies being arranged on opposite sides of the substrate holder. Such arrangement may allow a double side treatment, e.g. a double sided plating, that means, the substrate to be treated, which is held by the substrate holder, may have two surfaces to be treated essentially at the same time, wherein the surfaces are opposite to each other. In other words, one distribution body may be arranged below the substrate holder holding the substrate to be treated, dispensing electrolyte and/or a uniform current distribution in an upward direction, and one distribution body may be arranged above the substrate holder dispensing electrolyte and/or a uniform current distribution in a downward direction. While the substrate holder may be moving in-between the two distribution bodies in only one direction along the substrate holder length or in back and forth directions along the substrate holder length, a uniform treatment process, e.g. a uniform deposition process, may be achieved on both sides of the substrate at the same time.

Alternatively, the distribution bodies can be moved over a fixed substrate holder. The electrolyte may be also referred to as processing fluid.

There are various kinds of treating processes of the substrate that may be applied with the distribution body. such as (electro-) chemical treatment, (electro-) etching treatment, (electro-) plating treatment etc., which may be collectively referred to below by the term "plating".

In an embodiment, the substrate holder length may be a multiple of the distribution body length. Thus, the relative movement between the substrate holder and the distribution body may be mainly performed along the substrate holder length. This arrangement may allow a surface treatment to be a part of a continuous processing line, which e.g. may comprise the following stations: chucking/buffer for assembling the substrate to be treated into the substrate holder, pre-wetting the substrate to be treated, treating, e.g. plating, the substrate at least once, rinsing the treated, e.g. plated, substrate, drying the rinsed treated substrate, and de-chucking for disassembling the dried treated substrate from the substrate holder. The term "chucking" can be understood as e.g. loading the substrate to a chuck (substrate holder).

In an embodiment, the distribution body length may amount to about 50% or less of the substrate holder length, preferably about 20% or less of the substrate holder length. By limiting the length of the distribution body to less than the half of the length of the substrate holder, the substrate holder may be covered in at least two steps, without exceeding the surface of the substrate holder. Accordingly, a fine-tuning of the treatment areas of the substrate held by the substrate holder may be allowed. Additionally, by having the distribution body length less than about 50% of the substrate holder length allows correcting an erroneously treated substrate area (by for example, moving back and retreating the area). Therefore, the distribution body being smaller than the half of the substrate holder allows setting of the distribution body to the exact location of interest for surface treatment. In another embodiment, the distribution system may comprise multiple distribution bodies being arranged adjacent to each other on a side of the substrate holder. The sum of the distribution body length of the multiple distribution bodies may be equal to or larger than the substrate holder length. Such embodiment may allow performing multiple subsequent treating steps resulting in a higher throughput and/or an improved plating uniformity. Additionally, or alternatively, it may allow the formation of alloys by depositing different materials in a subsequent manner, or plating individual layers of materials, particularly of different materials, and/or subsequently plating individual layers with different deposition rates.

Yet in another embodiment, the multiple distribution bodies of the distribution system may be arranged on the same side of the substrate holder, not adjacent to each other but for instance, on different edges of the substrate holder. For example, two distribution bodies may be arranged on opposite edges, facing each other. In this embodiment, the distribution bodies may be moveable towards each other to meet, for instance, at a center point of the substrate holder. Yet, one of the distribution bodies may move faster or slower than the other to meet at another place on the substrate holder. Similarly, there may be more than two distribution bodies, for instance three or four, which are simultaneously moveable in different directions on the substrate holder.

In another embodiment, the distribution body width may be essentially equal to or larger than the substrate holder width. Thus, the relative movement between the substrate holder and the distribution body may substantially correspond to a movement in one direction, namely along the substrate holder length. This may allow using a transporting system, e.g. lateral guiding rails, guiding at least the distribution body along the substrate holder length. Additionally, the transporting system may guide the substrate holder in a transporting direction through the processing line mentioned above, the transporting direction extending along the substrate holder length. Further, the distribution body width may be larger or smaller than the distribution body length. The distribution body width may extend parallel to the substrate holder width and/or the distribution body length may extend parallel to the substrate holder length. Alternatively, the distribution body width may extend perpendicular to the distribution body length.

In yet another embodiment, the distribution body width may be smaller than the substrate holder width. In this case, the distribution body may be moveable in two directions on a plane parallel to the substrate holder. For sure, the distribution body may also be moveable in a third direction towards or away from the substrate holder.

In an embodiment, the distribution body may be moveable relative to the substrate holder. In another embodiment, the substrate holder may be moveable relative to the distribution body. In other words, there may preferably be only one of the substrate holder and the distribution body movable relative to the other one of the substrate holder and the distribution body. This may keep the distribution system simple while achieving a highly uniform, high speed, and high quality metal plating, especially on very large-scale substrates. Very large-scale substrates may refer to substrates sizes of at least 1500 mm×1800-1850 mm (corresponding to G6/GEN 6) or larger, particularly to 2160 mm×2460 mm (G8/GEN 8) or larger, more particularly to 2940 mm×3370 mm (G10.5/GEN 10.5) or larger. Additionally, high-speed plating on smaller substrates than G6, starting at about G3.5 (600 mm×720 mm) can be improved.

In another embodiment, the distribution system may further comprise a drive unit configured to move the distribution body and the substrate holder relative to each other. In one embodiment, the drive unit may be configured to move the distribution body and the substrate holder parallel to each other. In such case, the vertical distance between the distribution body and the substrate holder may be optimized for achieving a required processing fluid flow as well as a required current density distribution to achieve a high quality, uniform metal or metal alloy deposition on the substrate to be treated. In other words, the distribution body may define a processing area, wherein the processing areas of the distribution body and the substrate holder may be arranged in different planes.

In another embodiment, the drive unit may be configured to move the distribution body and the substrate holder with an angle relative to each other. In this case, the substantially non-parallel orientation may provide an additional design parameter to influence the deposition uniformity. Preferably, the angle may be such that a variation in the distance from the substrate holder may be provided along the substrate holder length. By moving in an angle, the plating thickness on the treated substrate may be adjusted.

In an embodiment, the drive unit may be configured to drive the distribution body and/or the substrate holder. Preferably, the drive unit may be configured to drive only one of the distribution body and the substrate holder.

In an embodiment, the drive unit may be configured to drive a relative scanning motion between the distribution body and the substrate holder along the substrate holder length. The scanning motion may be configured to enable the distribution body to move from one end to the opposite end in the direction of the substrate holder length, thereby enabling scanning and plating of a metal or a metal alloy onto the substrate being accommodated in the substrate holder. The drive unit may be configured to move the distribution body and the substrate holder relative to each other in only one direction along the substrate holder length or in back and forth directions along the substrate holder length.

Further, the drive unit may be configured to essentially horizontally immerse the substrate holder and/or the substrate into the process fluid, e.g. a bath of the process fluid. Alternatively, the drive unit may be configured to essentially vertically immerse the substrate holder and/or the substrate into the process fluid.

Additionally, or alternatively, in another embodiment, the drive unit may be configured to drive a relative agitation motion between the distribution body and the substrate holder along the substrate holder width and/or along the substrate holder length. The agitation motion may be a low, e.g. less than 1 Hz, or even higher frequency, e.g. 10 kHz to 4 MHz, agitation of the distribution body relative to the substrate holder. The agitation motion may be freely designable, this means the agitation motion may be performed in all spatial directions. Thus allows performing predetermined agitation-figures and/or agitation-patterns to optimize the treatment process, e.g. the plating, of the substrate. The agitation motion may correspond to a small motion similar to shaking or vibrating whereas the scanning motion is a forward and/or backward motion including a displacement and translation, respectively, for achieving that the distribution body scans the whole substrate surface at least once.

In an embodiment, the drive unit may allow motions in all spatial directions. For example, the drive unit may perform the scanning motion and the agitation motion simultaneously. Therefore, the drive unit may comprise at least two, preferably three, motion axes.

In an embodiment, the openings of the distribution body may comprise jet holes configured to direct the process fluid in the direction of the substrate holder. The jet holes may accelerate the process fluid flowing towards the substrate holder. By setting different dimensions, the speed of the process fluid reaching the substrate holder may be adjusted. The process fluid may enter the distribution body through at least one inlet and exit the distribution body through the jet holes. The jet holes may be exactly defined towards the substrate holder. Preferably, the distribution body and the substrate holder may be arranged such that the process fluid exiting the distribution body is substantially perpendicular to a surface of the substrate to be treated.

In an embodiment, the openings of the distribution body may comprise drain holes configured to drain off the process fluid from the substrate holder. Draining off here means drawing the process fluid away from the substrate holder. The drain holes may be provided to permit a backflow and with this a circulation of the process fluid through the distribution body. Accordingly, the used process fluid may be fed back into the distribution body.

In an embodiment, the distribution body may comprise at least one anode. By integrating the at least one anode into the distribution body, the at least one anode may be moved together with the distribution body. Therefore, there may be no need for an anode of the size of the substrate holder, and the anode may be of a reduced size. In an embodiment, the substrate holder and/or the substrate may be the cathode, and/or the substrate holder and/or the substrate may be cathodically polarized when in contact with process fluid.

According to a further embodiment, the distribution system may further comprise a rinsing unit configured to provide a liquid to rinse the substrate holder and/or the substrate. The rinsing unit may be configured to clean the substrate holder and/or the substrate from the process fluid after the treatment process, e.g., a so-called plating process. In an embodiment, the distribution system may further comprise a drying unit configured to provide a gas flow to dry the substrate holder and/or the substrate. Additionally or alternatively, the rinsing unit and/or the drying unit may be arranged at the distribution body or may be provided as a part separate to the distribution body.

After the treatment process is finished, the rinsing and optionally the drying of the substrate may be performed in the same bath by draining the process fluid from the bath and the distribution body with, e.g. rinsing water. The drying of the substrate holder and/or the substrate may be performed by replacing the rinse water with the gas, e.g. air, flow through the distribution body. Alternatively, for example, a second body, e.g. a rinse-and-drying body, may be following the distribution body in a certain distance performing the removal of process fluid residues with rinse water and drying the substrate.

In another embodiment, the distribution system may be implemented in a vertical configuration of the substrate at least during the treatment process. In this embodiment, the substrate may be immersed in an electrolyte bath and at least one distribution body may scan the surface to be treated of the substrate from top to bottom or from bottom to top. The overall treatment process may also be carried out by a multiple scan repeated from one direction to the other, and/or through alternate scanning from varying sides of the substrate. In this case, the electrolyte may be supplied through an immersion-type system, e.g. a tank filled with electrolyte, and/or additionally from within the at least one distribution body, dispensing the electrolyte onto the at least one surface to be treated. Furthermore, two distribution bodies may be implemented, one on each side of the substrate, or multiple distribution bodies, with more than one on each side of the substrate. Only the substrate areas in the vicinity of a distribution body are being plated with material.

Alternatively, the substrate may be supplied with the electrolyte only from within the at least one distribution body dispensing the required electrolyte onto the at least one surface to be treated. Additionally, or alternatively, the substrate may be supplied with the electrolyte through an electrolyte film being formed through a thin electrolyte film being distributed from the top of the substrate flowing downwards, thereby uniformly wetting the substrate surface area to be treated, e.g. an electrolyte "waterfall".

According to the present disclosure, also a use of a distribution system as described above for chemical and/or electrolytic surface treatment of a surface of a substrate is presented. It is in particular a use of the distribution system for a very large-scale substrates having dimensions of at least 1500 mm×1800 mm and larger, preferably of at least 2100 mm×2400 mm and larger, and more preferably of at least 2880 mm×3130 mm and larger. Of course, the distribution system as described above can also be used for smaller substrates, e.g. with dimensions of at least 300 mm×400 mm.

According to the present disclosure, also a processing line for a chemical and/or electrolytic surface treatment of a substrate is presented. The processing line comprises at least a distribution system as described above and at least a treating station, wherein the treatment station may be configured to be used for various electrolytic and/or chemical surface treatment processes of the substrate, e.g. (electro-) plating, (electro-) etching, (electro-) chemical, etc. The substrate is guided through the at least one treating station in a transport direction, wherein a surface of the substrate to be treated is arranged substantially perpendicular to the transport direction or wherein the surface of the substrate to be treated is substantially aligned with the transport direction. The terms "substantially perpendicular" and "substantially aligned" respectively, are to be understood as including small deviations from "perpendicular" and "aligned" respectively, preferably in a range of ±1-5 degrees, more preferably in a range of ±1-3 degrees.

The transport direction is to be understood as a general direction from the start of the processing line to the end of the processing line. During the transport or guiding of the substrate to be treated through the processing line, the substrate may also be moved in other directions, e.g. up and down with regard to the transport direction.

"Substantially perpendicular to the transport direction" is to be understood as that the surface to be treated is arranged within a plane, whose direction is essentially normal to the transport direction.

"Substantially aligned with the transport direction" is to be understood as essentially parallel to the transport direction, which means that the surface to be treated is arranged within a plane, of which only one extending direction corresponds to the transport direction.

Alternatively, the arrangement of the surface of the substrate may be described as substantially horizontal or substantially vertical. A "substantially horizontal" arrangement of the surface to be treated is to be understood as substantially parallel to a bottom of the processing line, and a "substantially vertical" arrangement of the surface to be treated is to be understood as substantially perpendicular to the bottom of the processing line.

In an embodiment, the processing line may further comprise several treating stations in order to perform multiple subsequent treating steps to obtain higher throughput and/or particularly, a better plating uniformity. Additionally, or alternatively, providing several treating stations may enable depositing different materials in a subsequent manner, which may allow the formation of alloys, or plating individual layers of materials, particularly of different materials, and/or subsequently plating individual layers with different deposition rates.

The processing line may further comprise a pre-wetting station and/or a rinsing station and/or a drying station. The stations may be arranged each in a separate processing chamber. Alternatively, at least some of the stations may be arranged together in a processing chamber.

Furthermore, the processing line may comprise a starting station and/or a mounting station at the beginning of the processing line and/or a demounting station and/or an ending station at the end of the processing line.

In an embodiment, a vertical, or partly vertical, or a mixed horizontal and vertical roll-to-roll processing may be implemented. Additionally, or alternatively, a roll-to-roll process may further comprise at least a section of an oblique roll-to-roll processing. The term oblique is to be understood as any possible arrangement of the roll-to-roll processing except for vertical and horizontal, respectively. Preferably, "oblique" corresponds to any deviation from a vertical or horizontal direction in a range of 5-85 degrees, more preferably in a range of 15-70 degrees, further more preferably in a range of 25-60 degrees. In this case, the processing line is configured to supply and receive a substantially rectangular substrate with an extremely long length, in a rolled-up status. The substrate may be held by guiding rails of the transport system configured to stabilize the substrate and to guide the substrate through the different processing stations.

In this embodiment, the processing chambers may be arranged in a mixed orientation, e.g. the pre-wetting station may be in a mainly horizontal design and operation mode while all the other processing chambers are in a vertical implementation. It may also be possible to arrange the individual processing stations in a way to be able to perform multiple subsequent treating steps to obtain higher throughput, and/or better plating uniformity, or to deposit different materials in a subsequent manner, which may allow the formation of alloys or plating individual layers of materials, particularly of different materials, and/or subsequently plating individual layers with different deposition rates.

According to the present disclosure, also a distribution method for a chemical and/or electrolytic surface treatment of a substrate is presented. The distribution method comprises the following steps:

providing a distribution body with several openings for a process fluid and/or an electric current, providing a substrate holder configured to hold the substrate to be treated, wherein the substrate holder has a substrate holder length and a substrate holder width, the distribution body has a distribution body length and a distribution body width, and the distribution body length is smaller than the substrate holder length, and moving the distribution body and the substrate holder relative to each other.

An optional embodiment of the distribution method may further comprises at least one of the following steps:

mounting the substrate to the substrate holder;

pre-wetting the distribution system and the substrate;

chemically and/or electrolytically treating a surface of the substrate at least once;

rinsing at least the substrate;

drying at least the substrate; and demounting the substrate of the substrate holder.

This method may be preferably applied to a processing line for chemical and/or electrolytic surface treatment of a substrate comprising at least one of the following chambers, preferably in this listed order:

chucking/buffer chamber;

pre-wet chamber;

at least one chemical and/or electrolytic treatment chamber;

rinsing chamber;

drying chamber; and de-chucking chamber.

The substrate holder and/or the distribution body may be guided by a transport system going through each chamber. Further, it should be noted that also combinations of the chambers are possible, e.g. a combined rinsing-and-drying chamber. Further, the chambers may be separate chambers being at least connected by the transport system, or alternatively, at least some of the chambers are merging into each other thereby forming a combined chamber comprising several stations. For example, the treatment chamber, the rinsing chamber and the drying chamber may be one combined chamber, wherein, while the substrate holder and/or the distribution body may be moving along the transport system in a transport direction, the substrate may be treated, e.g. getting plated, then after the treating process is finished, the substrate may be rinsed and then dried.

The method may come from the group of electrolytic or chemical surface treatments, and may comprise, in particular, a galvanic coating, chemical or electrochemical etching, anodal oxidation, or another method of external current- or electroless metal precipitation.

It shall be understood that the system and the method according to the independent claims have similar and/or identical preferred embodiments, in particular as defined in the dependent claims. It shall be understood further that a preferred embodiment of the disclosure can also be any combination of the dependent claims with the respective independent claim.

These and other aspects of the present disclosure will become apparent from and be elucidated with reference to the embodiments described hereinafter.

BRIEF DESCRIPTION OF THE DRAWINGS

Exemplary embodiments of the disclosure will be described in the following with reference to the accompanying drawings:

FIGS. 2*a* to 2*c* show schematically and exemplarily a distribution system according to the disclosure, wherein FIG. 2*a* shows a perspective view of a cross section of the distribution system, FIG. 2*b* shows an enlarged view of the detail II-b in FIG. 2*a*, and FIG. 2*c* shows a partial front view of FIG. 2*b*.

FIGS. 7*a* and 7*b* show schematically and exemplarily an enlarged view of the detail VII in FIG. 6, wherein FIG. 7*a* is a front view in direction of the distribution body width and 7*b* is a side view along the distribution body length.

DETAILED DESCRIPTION OF EMBODIMENTS

Figure 1:
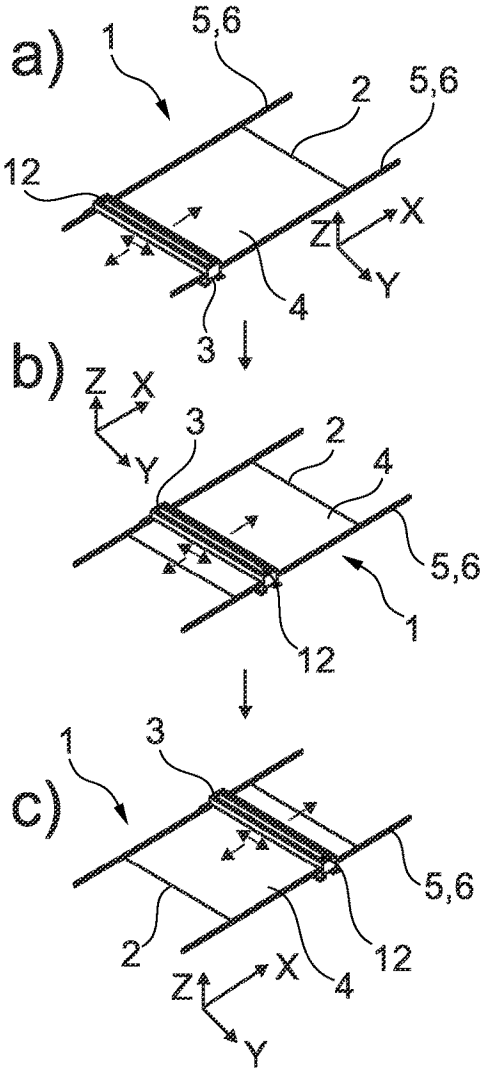
FIGS. 1*a* to 1*c* shows schematically and exemplarily an overview of the distribution system according to the disclosure, wherein a distribution body is moved relative to a substrate holder.

FIGS. 1*a* to 1*c* show schematically and exemplarily an embodiment of a distribution system 1 comprising a substrate holder 2 and a distribution body 3 for a process fluid 28 (see FIGS. 6 and 7) for a chemical and/or electrolytic surface treatment of a substrate 4. The substrate holder 2 and the distribution body 3 are arranged on a transport system 5 comprising two lateral guiding rails 6. FIGS. 1*a* to 1*c* show the substrate holder 2 holding the substrate 4 and the distribution body 3 is arranged above the substrate holder 2 and the substrate 4 in a Z-direction.

The substrate holder 2 is of a rectangular shape, a length L of which extends in an X-direction, and a width W extends substantially perpendicular to the length L, in a Y-direction. The distribution body 3 has a rectangular shape having a length 1 and a width w, wherein the length 1 extends in the same direction as the length L of the substrate holder 2, but the length 1 of the distribution body 3 is smaller than the length L of the substrate holder 2. The width w of the distribution body 3 is substantially equal to the width W of the substrate holder 2.

In this embodiment, the substrate holder 2 is fixed in position and the distribution body 3 is movable relative to the substrate holder along the X-direction, which is shown by the FIGS. 1*a* to 1*c*. Additionally, a movement of the distribution body 3 relative to the substrate holder 2 along the Y-direction is also possible. The movement along the X-direction corresponds to a scanning movement from one end of the substrate holder 2 to the other end thereby enabling the chemical and/or electrical surface treatment of the substrate while the movement along the Y- and/or Z-direction correspond to a low or even higher frequency agitation movement of the distribution body 3 relative to the substrate 4. FIGS. 1*a* to 1*c* show a horizontal mount of the substrate holder 2 and the distribution body 3, while a vertical arrangement would be also possible.

Figure 2C:
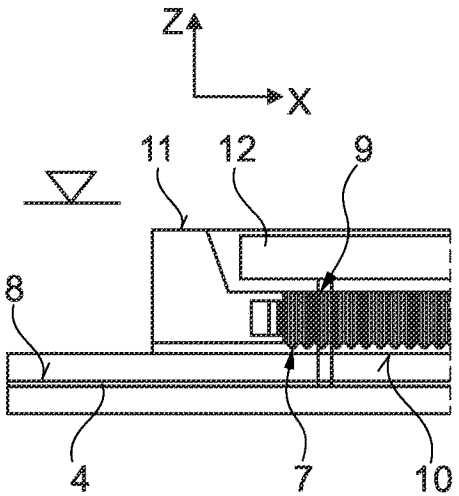
Figure 2A:
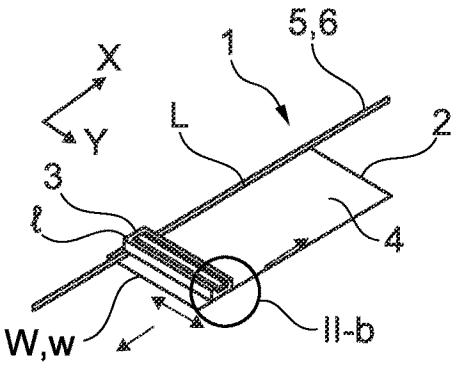
Figure 2B:
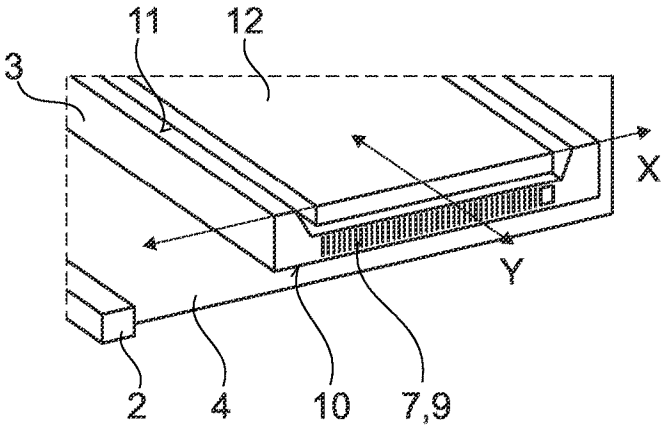

FIG. 2*a* shows schematically and exemplarily an embodiment of the distribution system 1 in a cross-sectional view of FIG. 1*b*, FIG. 2*b* shows an enlarged view of the detail II-b of FIG. 2*a* in a perspective view and FIG. 2*c* shows a partial enlarged front view of FIG. 2*b*. The distribution body 3 comprises jet holes 7 (see also FIG. 3) extending in the thickness direction Z such that the process fluid 28 exiting the jet holes 7 is directed substantially perpendicular to a surface 8 of the substrate 4 to be treated. Between adjacent jet holes 7, there are arranged through holes 9 functioning as drain holes allowing the process fluid 28 to flow from a front face 10 of the distribution body 3 to a rear face 11 of the distribution body 3. The front face 10 of the distribution body 3 corresponds to a surface facing towards the substrate 4 (and the substrate holder 2) while the rear face 11 is arranged opposite to the front face 10, thus facing away from the substrate 4. The distribution body 3 and the substrate 4 are spaced apart from each other.

Further, the distribution body 3 accommodates an anode 12 being one electrode of at least two electrodes to enable electrolytic treatment processes. The substrate holder 2 and/or the substrate 4 may act as a cathode 13 either by accommodating a cathode or by being connected to a cathode. For example, metal may be deposited on the substrate 4 by means of a galvanic reaction. The process fluid 28 is an electrolytic liquid and the electric field generated by the anode 12 and the cathode by means of the arrangement of the distribution body 3 comprising the anode 12 and the substrate 4 functioning as the cathode, always extends through the distribution body 3. By means of a suitable positioning of the distribution body 3 with regard to the substrate 4, regions of the substrate 4 may therefore be approached by the electrolytic liquid with a particularly uniform incoming flow and under a uniform electric field such that a reaction occurs uniformly at these locations.

Figure 3:
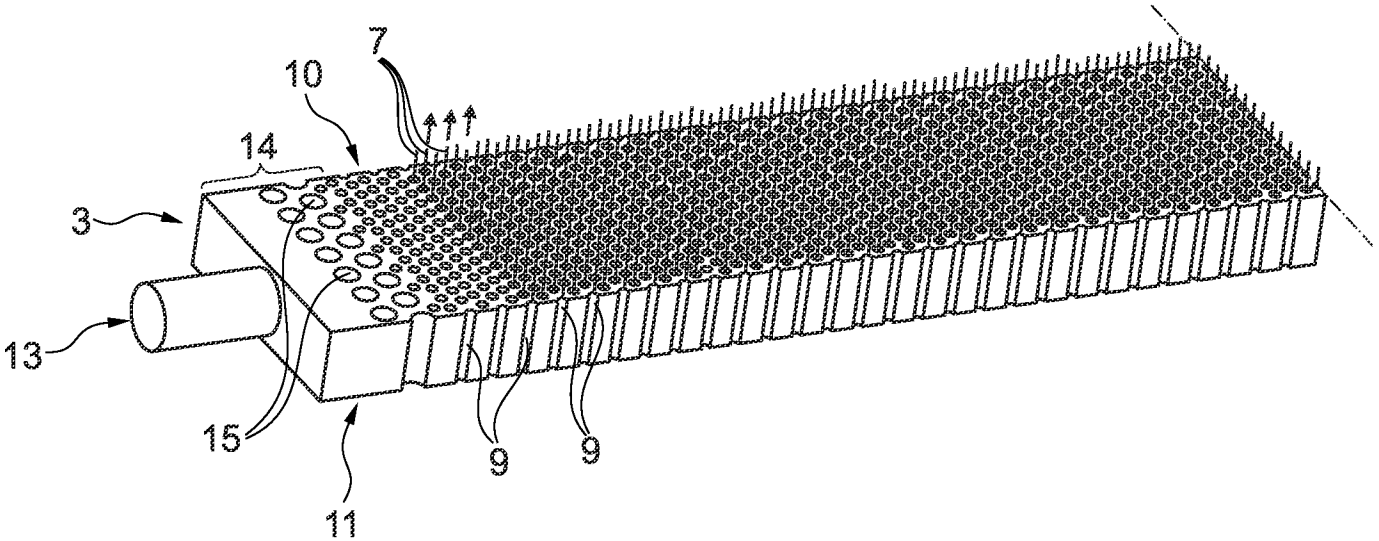
FIG. 3 shows schematically and exemplarily a perspective view of approximately a half of the distribution body according to the disclosure.

FIG. 3 shows schematically and exemplarily a perspective view of approximately a half of the distribution body 3. The distribution body 3 comprises an inlet 13, a flow control array 14, the jet holes 7 and the through holes 9. The inlet 13 is an entry of the process fluid into the distribution body 3. The flow control array 14 is arranged upstream of the jet holes 7 and the drain holes 9 with respect to a flow of the process fluid 28 and comprises several flow control elements 15. The flow control elements 15 upstream of the jet holes 7 allows equilibrating the flow of the process fluid 28 towards the jet holes 7 resulting in a uniform flow distribution. The uniform flow distribution leads to a uniform treating process, e.g. a plating process, and uniform plating results on the substrate 4 without reducing the overall flow speed of the process fluid 28. The jet holes 7 may have a diameter of about 1 mm, and the drain holes 9 being located adjacent to the jet holes 7 may have a diameter of about 5 mm. Due to the different size relation of the drain holes 9 and the jet holes 7, the liquid pressure and the flow speed are much lower in the drain holes 9. The process fluid 28 having reached the rear face 11 is re-pumped into the inlet 13 by means of a pump (not illustrated).

Figure 4:
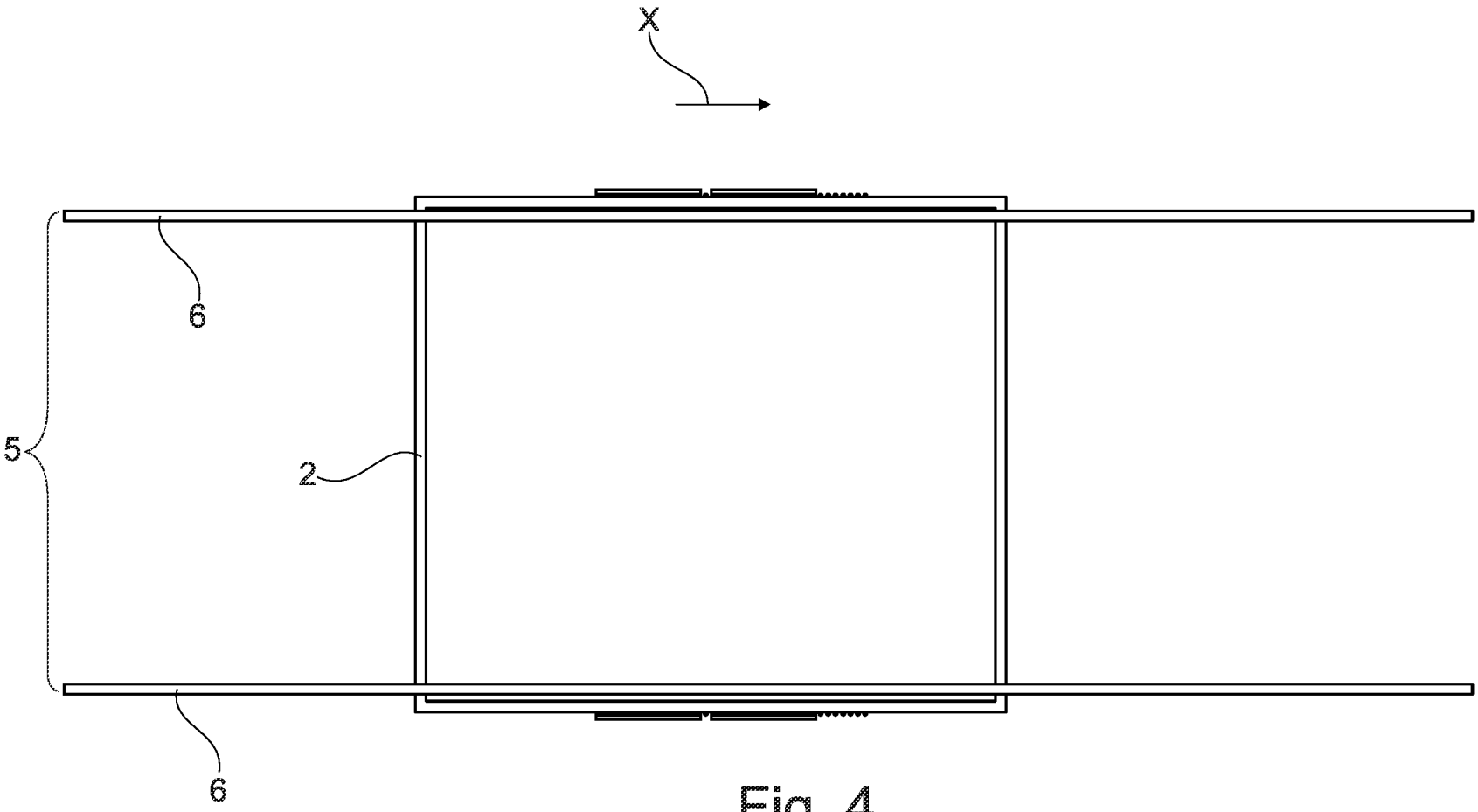
FIG. 4 shows schematically and exemplarily a top view of the substrate holder according to the disclosure mounted on a transport system.

FIG. 4 shows schematically and exemplarily a top view of the substrate holder 2 mounted on the guiding rails 6 of the transport system 5. The substrate holder 2 may be a vacuum substrate holder. The size of the substrate holder 2 depends on the size of the substrate 4, which can vary from 1500 mm×1850 mm to 2940 mm×3370 mm and more.

Figure 5:
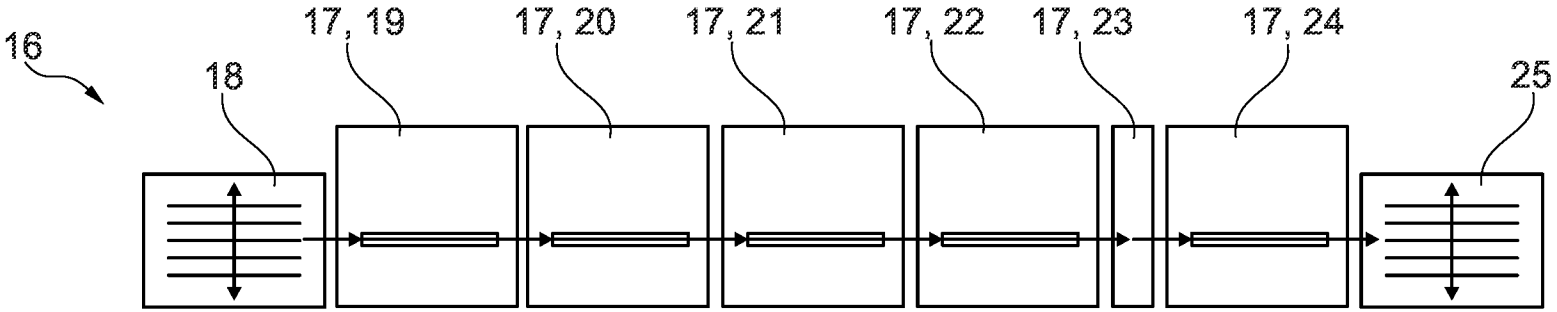
FIG. 5 shows schematically and exemplarily a processing line for a surface treatment of a substrate, comprising the distribution system according to the disclosure.

The transport system 5 may be part of a processing line 16 as schematically and exemplarily shown in FIG. 5. The processing line 16 comprises several chambers 17, each of which related to a predefined processing station. The processing line 16 as illustrated in FIG. 5 comprises the following stations:

- a starting station 18 for manually or automatically guiding the substrate holder 2 into the processing line 16,
- a mounting station 19 for mounting the substrate 4 to be treated to the substrate holder 2,
- a pre-wetting station 20 for pre-wetting the substrate 4 to reduce/eliminate and protect the substrate from surface-foreign particles and/or to avoid the formation of air-bubbles on the substrate,
- a treating station 21 for chemically and/or electrolytically treating, e.g. plating, the surface 8 of the substrate 4 by means of the distribution system 1,
- a rinsing station 22 for rinsing the substrate 4 with a rinsing fluid to wash off the process fluid which remains on the substrate 4,
- a drying station 23 for drying the substrate 4,
- a demounting station 24 for demounting the substrate 4 from the substrate holder 2, and
- an ending station 25 for manually or automatically guiding the substrate holder 2 out of the processing line 16.

Figure 6:
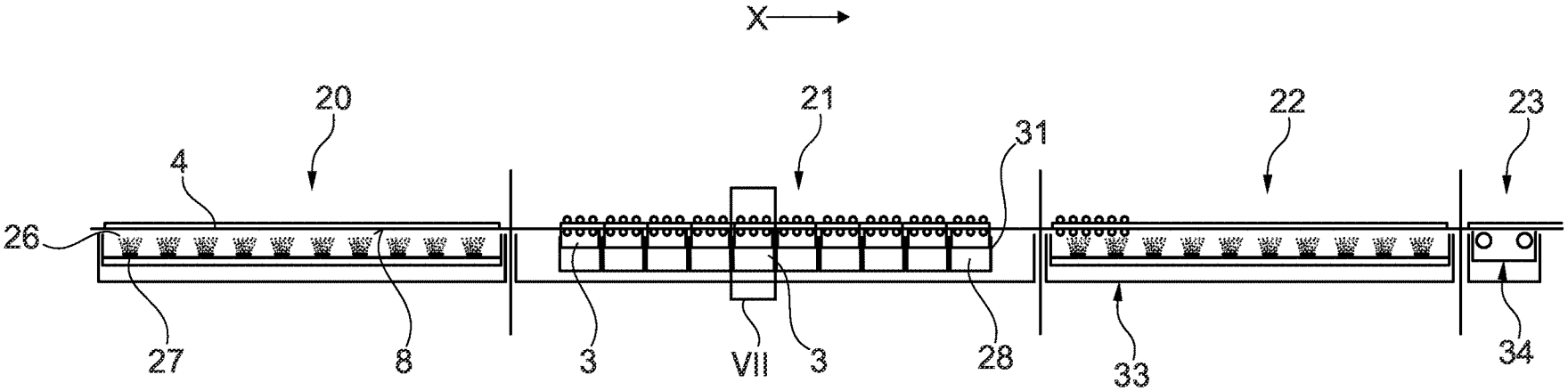
FIG. 6 shows schematically and exemplarily part of the processing line of FIG. 5 in cross section.

The processing line 16 may comprise more or less processing steps. Additionally or alternatively, some of the processing steps may be included in one single chamber, e.g., the treating, the rinsing and the drying of the substrate 4. FIG. 6 shows schematically and exemplarily the pre-wetting station 20, the treating station 21, the rinsing station 22 and the drying station 23 of the processing line 16 of FIG. 5 in cross section, wherein the treating station 21 is configured as a plating station 21. The substrate 4 being mounted on the substrate holder 2 is guided by the guiding rails 6 of the transport system in a transport direction corresponding to the X-direction first in the pre-wetting station 20. In the pre-wetting station 20, the substrate is sprayed with a cleaning and/or pre-wetting liquid 26 exiting spray nozzles 27 to reduce/eliminate and protect from surface-foreign particles and/or to avoid the formation of air-bubbles on the substrate, and especially inside crevices present on the substrate surfaces 8 of substrate 4 to be treated.

Next, the substrate 4 enters the plating station 21. At the plating station 21, the substrate 4 is treated by means of the distribution body 3 as described above. When seen in the transport direction X, the length 1 of the distribution body 3 is smaller than the length L of the substrate 4. Thus, for treating the whole surface 8 of the substrate 4, the substrate 4, by means of the substrate holder 2, and/or the distribution body 3 need to be moved. It should be noted that FIG. 6 shows the distribution body 3 several times to highlight the difference in the length of the substrate 4 and the distribution body 3 in the X-direction.

According to an exemplary embodiment, the relative movement between the substrate holder 2 holding the substrate 4 and the distribution body 3 is realized by moving the substrate holder 2 holding the substrate 4 relative to the distribution body 3 being mounted in a substantially fixed position. The fixed position means that the distribution body 3 is not moveable in the X-direction but is still capable of performing agitation and therefore, movable in the Y-direction and/or Z-direction.

Figure 7B:
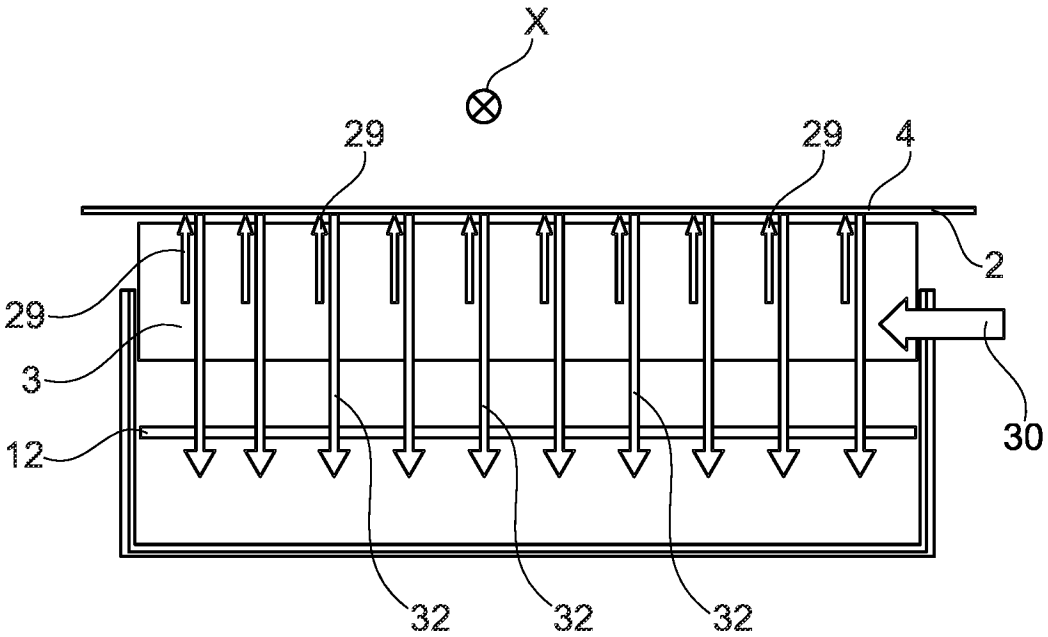
Figure 7A:
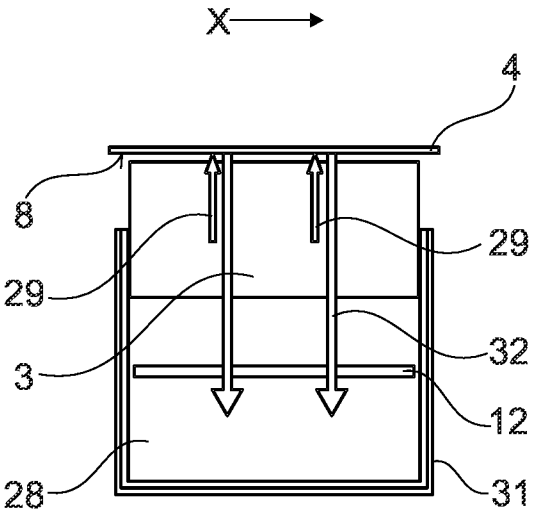

The substrate 4 being arranged above the distribution body 3, regarding the Z-direction, is moving along the transport direction X (see also FIG. 7*a*). As illustrated in the FIGS. 7*a* and 7*b*, while the substrate 4 is moved relative to the distribution body 3, the distribution body 3 discharges the process fluid 28 via the jet holes 7 with high speed towards the surface 8 to be treated, illustrated by the arrows 29. The process fluid 28 is supplied via the inlet 13, schematically illustrated by the arrow 30 in FIG. 7*b*. The process fluid 28, which fills the gap between the substrate 4 and the distribution body 3, returns via the drain holes 9 into a tank 31 containing the processing fluid 28, illustrated by the arrows 32. The distribution body 3 is at least partially immersed in the processing fluid 28, such that the anode 12 is fully immersed.

FIGS. 6, 7*a* and 7*b* illustrate an embodiment, wherein, in the Z-direction, the substrate 4 is arranged above the distribution body 3, and the distribution body 3 is at least partially immersed in the processing fluid 28 being stored in the processing fluid tank 31. As an alternative, the substrate 4 functioning as the cathode may be moved underneath the distribution body 3. As a further alternative, the substrate 4 may be arranged and moved between at least two distribution bodies 3, one distribution body 3 being arranged above the substrate 4 and the other distribution body 3 being arranged underneath the substrate 4.

FIGS. 6, 7*a* and 7*b* illustrate the processing line 16 being designed for a bottom-up processing. The bottom-up processing defines a processing, in which the substrate 4 is arranged such that a bottom side surface of the substrate 4 corresponds to the surface 8 to be treated, and wherein surface-treatment accessories, e.g. the spray nozzles 27, the distribution body 3, rinsing units 33, drying units 34, etc. are arranged underneath the substrate 4 with regard to the Z-direction. Further, the processing line 16 may be designed for a top-down processing and/or a double side processing. The top-down processing defines a processing, in which the substrate 4 is arranged such that a top side surface of the substrate 4 corresponds to the surface 8 to be treated and wherein the surface-treatment accessories are arranged above the substrate 4 with regard to the Z-direction. The double side processing defines a processing combining the bottom-up treatment and the top-down treatment, that means, the substrate 4 is arranged such that both opposite side surfaces, the bottom side surface and the top side surface, of the substrate each corresponds to the surface 8 to be treated. Therefore, for the double side processing, the surface-treatment accessories are arranged above as well as underneath the substrate 4 with regard to the Z-direction.

With reference back to FIG. 5, the processing line 16, can also be envisioned as a so called roll-to-roll process. Roll-to-roll processing is also known as web processing, reel-to-reel (R2R) processing and particularly allows processing of extremely long substrates, which are sufficiently flexible to be transported in rolls. In this case, the starting station 18 and the ending station 25 are designed for supplying and receiving a substantially rectangular substrate with an extremely long length, in a rolled-up status. For example, such substrates may have up to a few metres in width and may have up to several kilometres in length, e.g. 50 kilometres. In the field of electronic devices, roll-to-roll processing is defined as a process of creating electronic devices on a roll of flexible substrates, such as plastic or metal foils, and can be used for, e.g. the manufacturing of flexible or rollable displays.

According to another exemplary embodiment, the relative movement between the substrate holder 2 holding the substrate 4 and the distribution body 3 is realized by moving the distribution body 3 relative to the substrate holder 2 holding the substrate 4, being in a fixed position. The substrate 4 functioning as the cathode may be horizontally immersed in the process fluid 28. Regarding the Z-direction, the distribution body 3 is placed above the substrate 4, substantially parallel to the surface 8 to be treated and is movable in the X-direction allowing scanning the surface 8 of the substrate 4 from one end to the other end in the X-direction for treating the surface 8 of the substrate 4, e.g. by plating of a metal or a metal alloy onto the surface 8. As an alternative, the distribution body may be at least partially immersed, such that the anode 12 is immersed in the process fluid, and moved underneath the substrate holder 2 holding the substrate 4 with the surface 8 directed towards the distribution body 3. As a further alternative, the substrate 4 may be arranged between at least two distribution bodies 3, one distribution body 3 being arranged and moved above the substrate 4 and the other distribution body 3 being arranged and moved underneath the substrate 4.

In yet another embodiment, instead of placing the distribution body 3 substantially parallel to the surface 8 of the substrate 4, the distribution body 3 is placed substantially non-parallel to the surface 8 of the substrate 4 in order to provide for an additional design parameter to influence the deposition uniformity. Thus, the front face 10 of the distribution body 3 displays a variation in the distance from the substrate 4 in the X-direction.

For all above described embodiments, the vertical distance between the distribution body 3 and the substrate 4 is predefined for achieving a required electrolyte flow as well as a required current density distribution to obtain a high quality, uniform metal or metal alloy deposition. Further, the scanning speed, meaning the speed with which the relative movement is performed, is defined to mainly achieve the required plating thickness and uniformity distribution for the plating material, e.g. metal or metal alloy. Further, the applied current density, the deposition temperature, as well as the composition of the process fluid 28, e.g. concentration of the metal ions or ions from multiple metal species, are additional parameters for achieving a preferred plating speed and for defining the quality of the deposited layer. The scanning movement may be realized by moving the distribution body 3 and/or the substrate holder 2 by a drive unit (not illustrated).

Although, the anode 12 is described as being accommodated in the distribution body 3, thereby moving with the distribution body 3, the anode 12 may be provided separately from the distribution body 3 and/or in a stationary position.

With reference back to FIGS. 5 and 6, after the treatment of the surface 8 of the substrate 4 is finished, the substrate is moved to the rinsing station 22 comprising a rinsing unit 33 for rinsing the substrate 4, and the drying station 23 comprising a drying unit 34, e.g. a gas flow. Alternatively, the rinsing and drying of the substrate 4 may be performed in the plating station 21 in the same bath tank 31 by draining or replacing the process fluid 28 from the bath tank 31 as well as from the distribution body 3 with rinsing fluid, e.g. water. The drying may be performed by replacing the rinsing fluid with a gas flow, e.g. air or nitrogen flow through the distribution body 3. As an alternative, a separate second body, a rinse-and-drying body may follow the distribution body 3 in a certain distance performing the removal of the process fluid 28 residues with rinsing fluid and then drying the substrate 4. In an embodiment, the rinsing and/or drying of the substrate 4 may be performed on both sides of the substrate 4.

Instead of performing the relative movement only in one direction once, it is also possible to perform the relative movements as a back-and-forth movement, such that the distribution body 3 may scan the substrate 4 two or multiple times.

Furthermore, it should be noted that the front face 10 of the distribution body refers to the face directed towards the substrate 4, and the surface 8 refers to the surface to be treated, which is directed towards the distribution body 3. Thus, seen in the Z-direction, when the substrate 4 is arranged above the distribution body 3, the surface 8 to be treated corresponds to the bottom surface of the substrate 4 and the front face 10 corresponds to the top face of the distribution body 3. When the substrate 4 is arranged underneath the distribution body 3, the surface 8 to be treated corresponds to the top surface of the substrate 4 and the front face 10 corresponds to the bottom face of the distribution body 3. In other words, the front face 10 of the distribution body and the surface 8 of the substrate 4 are arranged facing each other.

Figure 8:
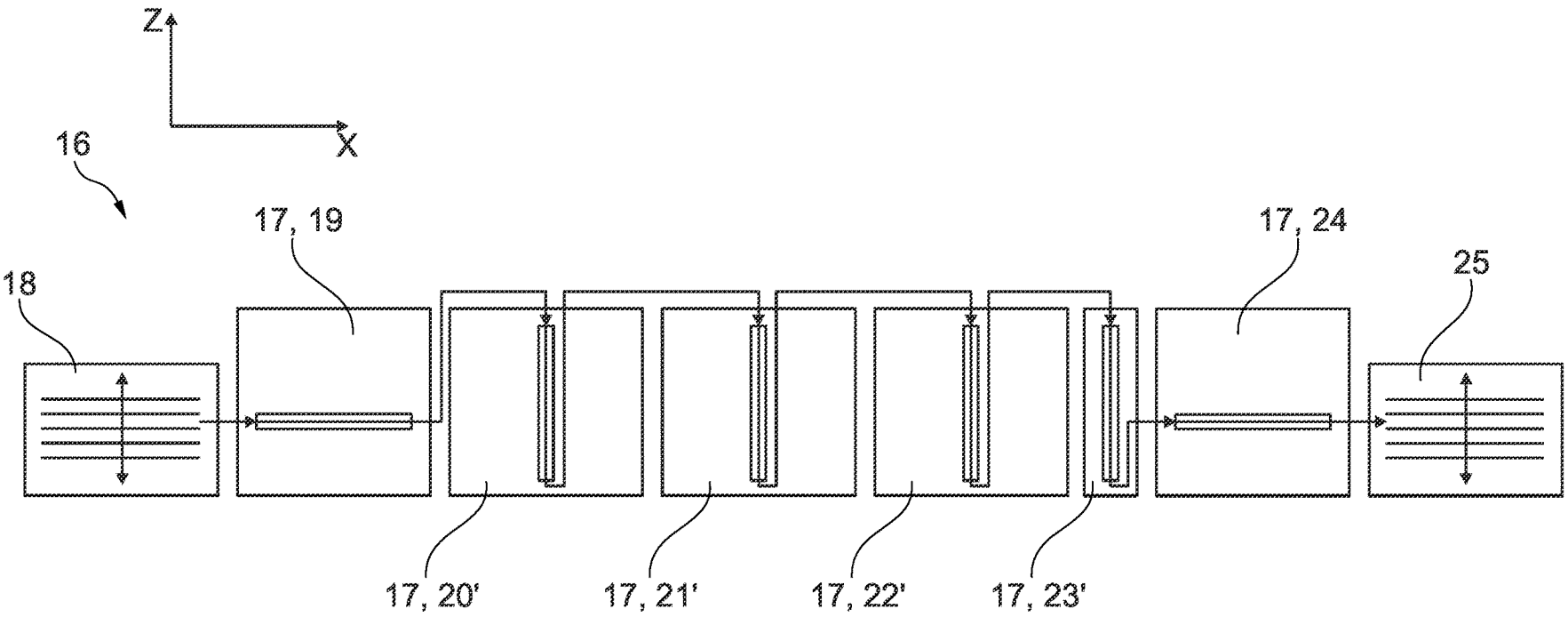
FIG. 8 shows schematically and exemplarily a processing line for a surface treatment of a substrate, comprising the distribution system according to the disclosure.
Figure 9:
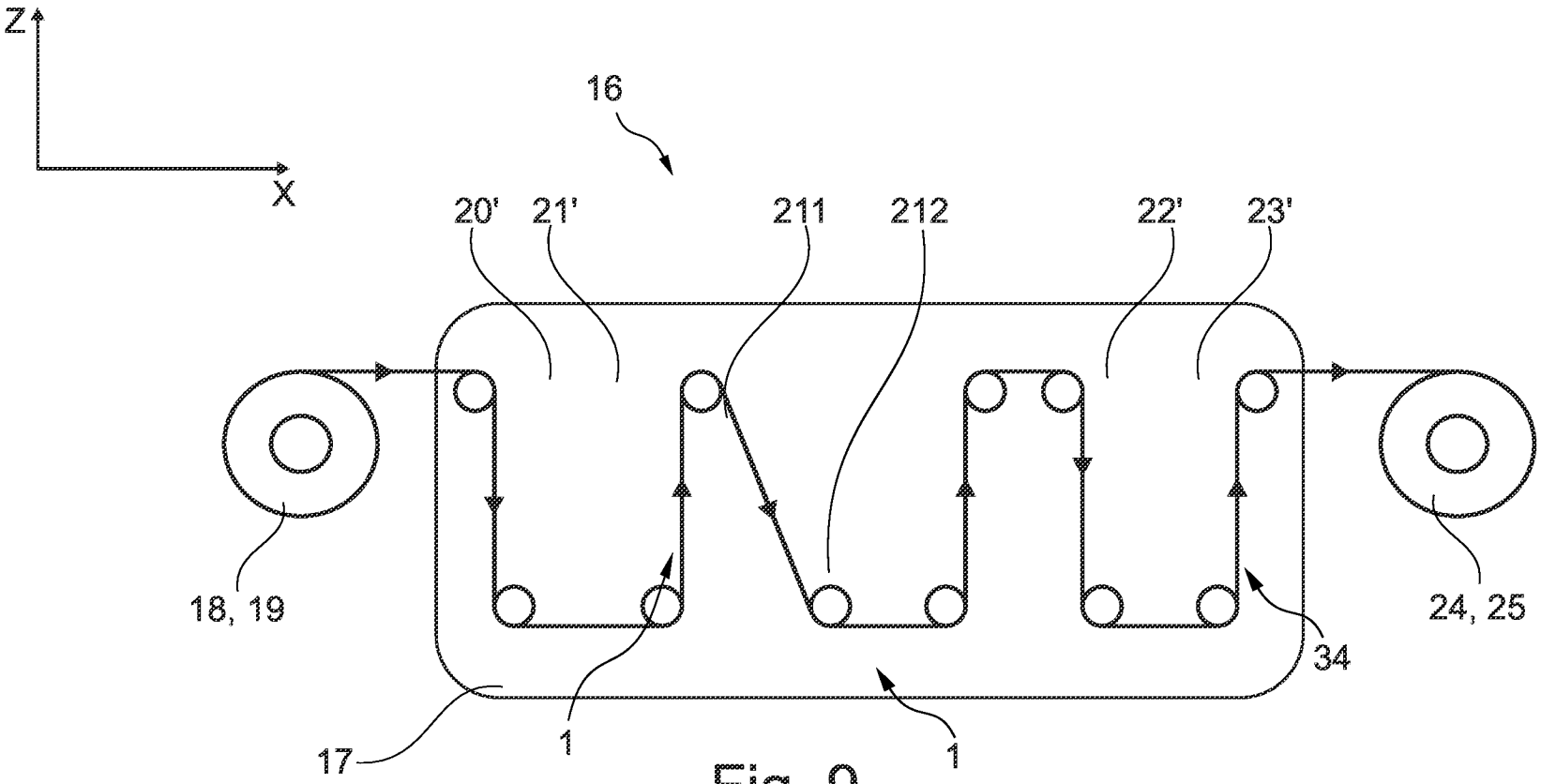
FIG. 9 shows schematically and exemplarily a processing line for a surface treatment of a substrate, comprising the distribution system according to the disclosure.

FIGS. 8 and 9 show each an embodiment of the processing line 16 comprising several chambers 17, each of which is related to a predefined processing station. The processing line 16 as illustrated in FIG. 8 comprises the following stations:

- a starting station 18 for manually or automatically guiding the substrate holder 2 into the processing line 16,
- a mounting station 19 for mounting the substrate 4 to be treated to the substrate holder 2,
- a pre-wetting station 20' for pre-wetting the substrate 4 to reduce/eliminate and protect the substrate 4 from surface-foreign particles and/or to avoid the formation of air-bubbles on the substrate 4,
- a treating station 21' for chemically and/or electrolytically treating, e.g. plating, the surface 8 of the substrate 4 by means of the distribution system 1,
- a rinsing station 22' for rinsing the substrate 4 with a rinsing fluid to wash off the process fluid which remains on the substrate 4,
- a drying station 23' for drying the substrate 4,
- a demounting station 24 for demounting the substrate 4 from the substrate holder 2, and
- an ending station 25 for manually or automatically guiding the substrate holder 2 out of the processing line 16.

The processing line 16 may comprise more or less processing steps. Additionally or alternatively, some of the processing steps may be included in one single chamber, e.g., the treating, the rinsing and the drying of the substrate 4.

Contrary to the exemplary processing line 16 illustrated in FIG. 5, the processing line 16 illustrated in FIG. 8 is configured to treat the substrate 4 substantially vertically. This means that the substrate 4 is arranged substantially orthogonally to the overall transport direction (here, the X-direction) in the chambers 17. The means for treating and/or processing the substrate 4, further referred to as processing means, such as the spray nozzles 27 for pre-wetting the substrate 4, the distribution body 3 for treating the surface 8 of the substrate 4, the rinsing and drying units 33, 34 etc., are arranged correspondingly. Thus, the at least one distribution body 3 is arranged such that the scanning motion is performed along the Z-direction enabling a scanning of the surface 8 from top to bottom and/or from bottom to top of the substrate 4. The agitation movement is then performed in the Y- and/or X-direction. Also an additional agitation movement in the Z-direction, overlayed to the scanning motion can be envisioned.

Thus, according to the exemplary embodiment shown in FIG. 8, the starting station 18, the mounting station 19, the demounting station 24 and the ending station 15 are configured in the same way as the corresponding stations 18, 19, 24 and 25 as shown in FIG. 5. The pre-wetting station 20' may correspond to the pre-wetting station 20 of FIG. 5 or may be built to treat the substrate 4 in a mainly vertical direction.

The treating station 21' may be built in a way to enable vertical processing of the substrate 4, wherein the at least one distribution body 3 may be scanning the surface 8 of the substrate 4 from top to bottom or from bottom to top and/or in an agitated mode, back and forth.

The rinsing station 22' and the drying station 23' may also be built in a vertical design for treating the substrate in a mainly vertical direction.

In this embodiment, the substrate 4 can be immersed in an electrolyte bath, e.g. in the processing fluid 28, and at least one distribution body 3 is scanning the substrate 4 from top to bottom or from bottom to top. The overall deposition process can also be carried out by a multiple scan repeated from one direction to the other, or through alternate scanning from varying sides of the substrate 4. In this case, the processing fluid 28 is supplied through an immersion-type system, e.g. a separate tank filled with the processing fluid 28 (not illustrated), and/or additionally from within the at least one distribution body 3, dispensing the processing fluid 28 onto at least one of the surfaces 8. The implementation may also include two distribution bodies 3, one on each side, or multiple distribution bodies 3, with more than one on each side. Only the substrate areas in the vicinity of a distribution body are being plated with material.

Alternatively, the substrate 4 may be supplied with the processing fluid 28 only from within the at least one distribution body 3 dispensing the required processing fluid 28 onto at least one of the surfaces 8.

According to a further embodiment, the substrate 4 may be supplied with the processing fluid 28 through a processing fluid film being formed by a thin processing fluid film being distributed from the top of the substrate 4 flowing downwards, thereby uniformly wetting the surface 8 to be treated, e.g. like a "waterfall" of processing fluid 28, and/or from within the at least one distribution body 3, dispensing the processing fluid 28 onto at least one of the surfaces 8.

In other embodiments, the pre-wetting station 20' and the treating station 21' may be included in the same processing chamber 17, configured to process the substrate 4 in a mainly vertical direction. Additionally, or alternatively, the rinsing station 22, 22' and the drying station 23, 23' may be integrated in one processing chamber 17.

FIG. 9 shows an embodiment of the processing line 16 configured to move or guide a substrate 4 through fixed (stationary) arranged processing means for treating the surface 8 of the substrate 4. Thus, the surface 8 of the substrate 4 is processed by moving the substrate 4 relative to the processing means. In FIG. 9, the treating station 21' is configured as a plating station 21' and comprises two sub-plating stations 211, 212. It is also possible, that the plating station 21, 21' comprises less or more than two sub-plating stations.

In another embodiment, the processing line 16 only comprises one processing chamber 17 within which the pre-wetting station 20, 20', the plating station 21, 21', the rinsing station 22, 22' and the drying station 23, 23' are arranged such that pre-wetting, plating, rinsing and drying of the substrate 4 is carried out within one processing chamber 17. During pre-wetting, rinsing and drying of the substrate 4, the at least one distribution body 3 can be located in a parking position, e.g. at the bottom of the processing chamber 17.

In yet another embodiment, a vertical, or partly vertical, or a mixed horizontal and vertical roll-to-roll processing of the substrate 4 may be implemented. In such case, the starting station 18 and the ending station 25 may be designed for supplying and receiving a substantially rectangular substrate 4 with an extremely long length, in a rolled-up status. The processing chambers 17 may be applied especially in a mixed orientation, e.g. the pre-wetting station 20 can be in a mainly horizontal design and operation mode while all the other processing chambers 17 are in a vertical implementation. It may also be possible to arrange the individual processing stations in a way to be able to perform multiple subsequent plating steps to obtain a higher throughput, and/or a better plating uniformity, and/or to deposit or plate different materials in a subsequent manner (see FIG. 9).

FIG. 9 shows an exemplary embodiment combining all of the above. This means, the processing line 16 comprises only one processing chamber 17 having four sections, each corresponding to one of the pre-wetting station 20', the plating station 21', the rinsing station 22' and the drying station 23'. The pre-wetting station 20' mixes vertical and horizontal processing, e.g. for combining immersion and spray for pre-wetting the substrate 4. The plating station 21' comprises two sub-plating stations 211, 212, which exemplarily perform a double-sided plating process.

The first sub-plating station 211 exemplarily and schematically shows the distribution system 1 arranged for vertically processing the substrate 4 double-sided. The second sub-plating station 212 exemplarily and schematically shows the distribution system 1 arranged for horizontally processing the substrate 4 double-sided. Between the first and the second sub-plating stations 211, 212, the substrate 4 is guided at an oblique angle, preferably of 45 degrees. The drying station 23' exemplarily and schematically shows a drying unit 34 arranged for vertically processing the substrate 4 double-sided.

It is to be noted that the embodiment as shown in FIG. 9 is only exemplary and may further include features of previously described embodiments. For example, the processing line 16 of FIG. 9 may be configured to process the substrate 4 single-sided. Furthermore, all possible variations described with regard to the FIGS. 5, 6, 7*a* and 7*b* are also applicable to the vertical and/or oblique and/or mixed horizontal, vertical and oblique configuration of the substrate as exemplarily illustrated in FIGS. 8 and 9.

Figure 10:
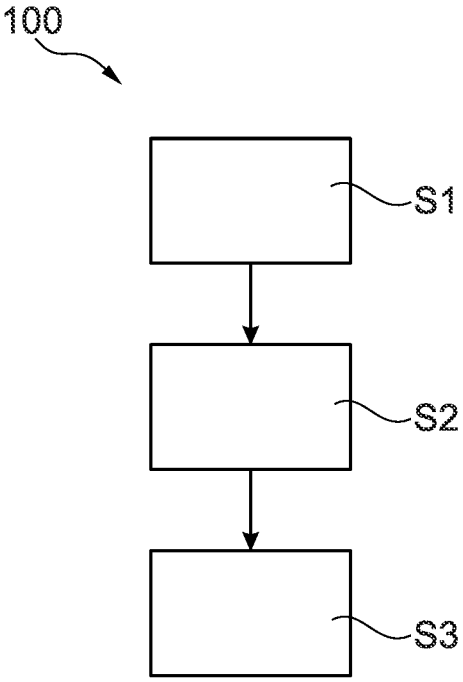
FIG. 10 shows a schematic and exemplary flow diagram of a distribution method according to the disclosure.

FIG. 10 shows a flow diagram of an exemplary distribution method 100 for a chemical and/or electrolytic surface treatment of the substrate 4. According to the distribution method 100, in a step S1, there is provided a distribution body 3 comprising several openings, e.g. the jet holes 7 and the drain holes 9, for the process fluid 28 and/or an electric current. Further, in a step S2, there is provided a substrate holder 2 configured to hold the substrate 4 to be treated. The substrate holder 2 has the substrate holder length L and the substrate holder width W, the distribution body 3 has the distribution body length 1 and the distribution body width w, and the distribution body length 1 is smaller than the substrate holder length L. In a step S3, the distribution body 3 and the substrate holder 2 are moved relative to each other, thereby performing a surface treatment of the surface 8 of the substrate 4.

While the disclosure has been illustrated and described in detail in the drawings and foregoing description, such illustration and description are to be considered illustrative or exemplary and not restrictive. The disclosure is not limited to the disclosed embodiments. Other variations to the disclosed embodiments can be understood and effected by those skilled in the art in practicing a claimed disclosure, from a study of the drawings, the disclosure, and the dependent claims.

In the claims, the word "comprising" does not exclude other elements or steps, and the indefinite article "a" or "an" does not exclude a plurality. A single unit may fulfil the functions of several items re-cited in the claims. The mere fact that certain measures are re-cited in mutually different dependent claims does not indicate that a combination of these measures cannot be used to advantage. Any reference signs in the claims should not be construed as limiting the scope.

The invention claimed is:

1. A distribution system for a process fluid for a chemical and/or electrolytic surface treatment of a substrate, comprising:

a distribution body, and a substrate holder, wherein the substrate holder has a substrate holder length (L) and a substrate holder width (W) and is configured to hold the substrate to be treated, wherein the distribution body comprises several openings for a process fluid and/or an electric current, wherein the openings comprise jet holes and drain holes, wherein the distribution body and the substrate holder are moveable relative to each other, wherein the distribution body has a distribution body length and a distribution body width (w), and wherein the distribution body length is smaller than the substrate holder length (L), wherein the distribution body comprises a front face facing towards the substrate holder and a rear face opposite the front face, the front face and the rear face forming a space in between the jet holes being provided on the front face of the distribution body, the jet holes are directing the process fluid entering the space within the distribution body from an inlet in a direction of the substrate holder, the drain holes being provided as through holes between the front face and the rear face and allowing the process fluid with the electric current to flow between the front face and the rear face of the distribution body.

2. The distribution system according to claim 1, comprising at least two distribution bodies being arranged on opposite sides of the substrate holder.

3. The distribution system according to claim 1, wherein the substrate holder length (L) is a multiple of the distribution body length.

4. The distribution system according to claim 1, comprising multiple distribution bodies being arranged adjacent to each other on a side of the substrate holder, wherein the sum of the distribution body length of the multiple distribution bodies is equal to or larger than the substrate holder length (L).

5. The distribution system according to claim 1, wherein the distribution body length amounts to about 50% or less of the substrate holder length (L).

6. The distribution system according to claim 1, wherein the distribution body width (w) is essentially equal to or larger than the substrate holder width (W).

7. The distribution system according to claim 1, wherein the distribution body is moveable relative to the substrate holder.

8. The distribution system according to claim 1, wherein the substrate holder is moveable relative to the distribution body.

9. The distribution system according to claim 1, further comprising a drive unit configured to move the distribution body and the substrate holder relative to each other.

10. The distribution system according to claim 9, wherein the drive unit is configured to move the distribution body and the substrate holder parallel or with an angle relative to each other.

11. The distribution system according to claim 9, wherein the drive unit is configured to drive the distribution body and/or the substrate holder.

12. The distribution system according to claim 9, wherein the drive unit is configured to drive a scanning motion between the distribution body and the substrate holder along the substrate holder length (L).

13. The distribution system according to claim 9, wherein the drive unit is configured to drive an agitation motion between the distribution body and the substrate holder along the substrate holder width (W) and/or along the substrate holder length (L).

14. The distribution system according to claim 1, wherein the openings of the distribution body comprise drain holes configured to drain off the process fluid from the substrate holder.

15. The distribution system according to claim 1, wherein the distribution body comprises at least one anode.

16. The distribution system according to claim 1, wherein the substrate holder and/or the substrate is the cathode.

17. The distribution system according to claim 1, further comprising:

a rinsing unit configured to provide a liquid to rinse the substrate holder and/or the substrate, and/or a drying unit configured to provide a gas flow to dry the substrate holder and/or the substrate, wherein the rinsing unit and/or the drying unit is/are arranged at the distribution body or is/are provided as a separate part separate to the distribution body.

18. A processing line for a chemical and/or electrolytic surface treatment of a substrate, comprising:

at least a distribution system according to claim 1, and at least a plating station, wherein the substrate is guided through the plating station in a transport direction (X), and wherein a surface of the substrate to be treated is arranged substantially perpendicular to the transport direction (X), or wherein the surface of the substrate to be treated is substantially aligned with the transport direction (X).

19. A distribution method for a chemical and/or electrolytic surface treatment of a substrate, comprising:

providing a distribution body with several openings for a process fluid and/or an electric current, wherein the openings comprise jet holes and drain holes, providing a substrate holder configured to hold the substrate to be treated, wherein the substrate holder has a substrate holder length (L) and a substrate holder width (W), the distribution body has a distribution body length and a distribution body width (w), and the distribution body length is smaller than the substrate holder length (L), and moving the distribution body and the substrate holder relative to each other, wherein the distribution body comprises a front face facing towards the substrate holder and a rear face opposite the front face, the front face and the rear face forming a space in between, the jet holes being provided on the front face of the distribution body, the jet holes are directing the process fluid entering the space within the distribution body from an inlet in a direction of the substrate holder, the drain holes being provided as through holes between the front face and the rear face and allowing the process fluid with the electric current to flow between the front face and the rear face of the distribution body.

* * * * *